United States Patent [19]

Gloomis et al.

[11] Patent Number: 4,575,908

[45] Date of Patent: Mar. 18, 1986

[54] LOCK FOR SEAT BELT BUCKLE

[75] Inventors: Lawrence A. Gloomis, Sterling Heights; Wendy M. Schoof, Utica, both of Mich.

[73] Assignee: General Motors Corporation, Detroit, Mich.

[21] Appl. No.: 751,893

[22] Filed: Jul. 5, 1985

[51] Int. Cl.[4] ..... A44B 11/26

[52] U.S. Cl. ..... 24/650; 24/633; 24/637; 24/639

[58] Field of Search ..... 24/650, 652, 633, 636, 24/637, 639, 640, 642, 644

[56] References Cited

U.S. PATENT DOCUMENTS

| | | | |
|---|---|---|---|
| 3,600,769 | 8/1971 | Bachmann | 24/650 |
| 4,064,603 | 12/1977 | Romanzi, Jr. | 24/650 |
| 4,195,392 | 4/1980 | Ueda et al. | 24/637 |
| 4,232,433 | 11/1980 | Ueda et al. | 24/637 |
| 4,384,391 | 5/1983 | Lindblad et al. | 24/633 |

*Primary Examiner*—Victor N. Sakran
*Attorney, Agent, or Firm*—Charles E. Leahy

[57] ABSTRACT

A seat belt buckle includes a body having a latch lever pivotally mounted thereon and including a tang struck therefrom. The latch lever has a pushbutton portion which registers with an opening in a cover attached to the body. A spring biases the latch lever to a latching position in which the tang engages into an aperture of a latch plate inserted into the buckle. A locking member, preferably of molded plastic, is slidably mounted on the underside of the buckle body and manually movable between a locking condition in which a locking abutment of the locking member blocks depression of the latch lever by the pushbutton and unlocking position enabling the pivoting of the latch lever to withdraw the tang from the aperture of the latch plate. The locking member includes an integral spring arm carrying a detent tab which engages the buckle body to retain the locking member in either its locking or unlocking positions.

3 Claims, 4 Drawing Figures

LOCK FOR SEAT BELT BUCKLE

The invention relates generally to a seat belt buckle and more particularly provides a lock which blocks the release of the buckle by the pushbutton.

BACKGROUND OF THE INVENTION

It is well known in the motor vehicle to restrain an occupant on a vehicle seat through the use of a safety belt having a buckle interposed therein so that the belt can be separated to permit occupant ingress and egress.

Conventional seat belt buckles are connected to one segment of the belt and have a pushbutton which the occupant depresses to unlatch a latch plate connected to another segment of the belt.

It would be desirable to provide a seat belt buckle having a locking device conveniently associated therewith for locking the release of the buckle by an attempted depression of the pushbutton.

SUMMARY OF THE INVENTION

A seat belt buckle according to the invention includes a body having a latch lever pivotally mounted thereon and including a tang struck therefrom. The latch lever has a pushbutton portion which registers with a pushbutton opening in a cover suitably attached to the body. A spring biases the latch lever to a normal position in which the tang engages into an aperture of a latch plate inserted into the buckle. A locking member, preferably of molded plastic, is slidably mounted on the underside of the buckle body and manually movable between a locking condition in which a locking abutment of the locking member blocks depression of the latch lever by the pushbutton and unlocking position enabling the pivoting of the latch lever to withdraw the tang from the aperture of the latch plate. The locking member includes an integral spring arm carrying a detent tab which engages the buckle body to retain the locking member in either its locking or unlocking positions.

BRIEF DESCRIPTION OF THE DRAWINGS

These and other features, objects and advantages of the invention will become apparent upon consideration of the specification and the appended drawings in which.

DESCRIPTION OF THE PREFERRED EMBODIMENT

Figure 1:
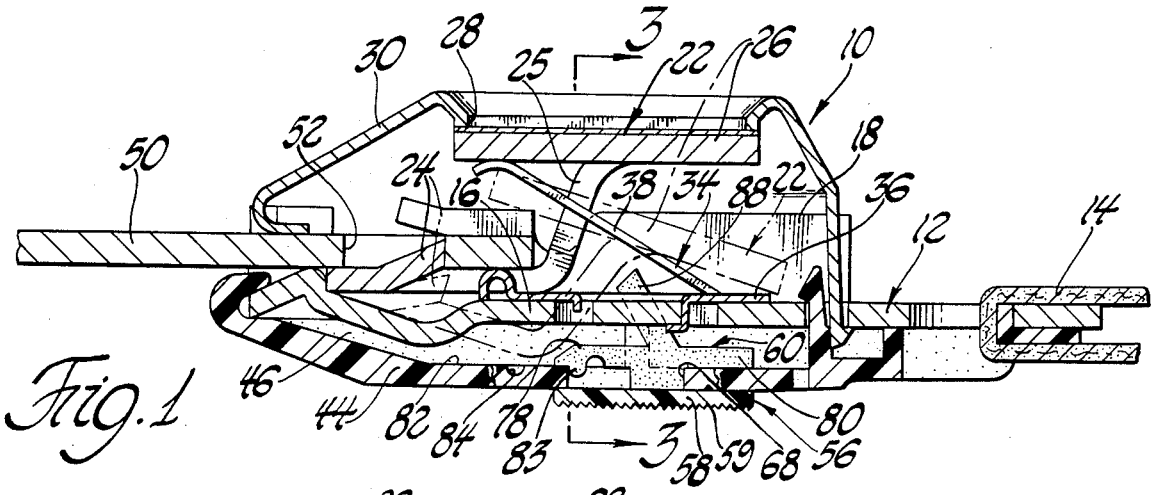
FIG. 1 is a side elevation view of a conventional prior art seat belt buckle having the locking member of this invention shown in the unlocking position.
Figure 3:
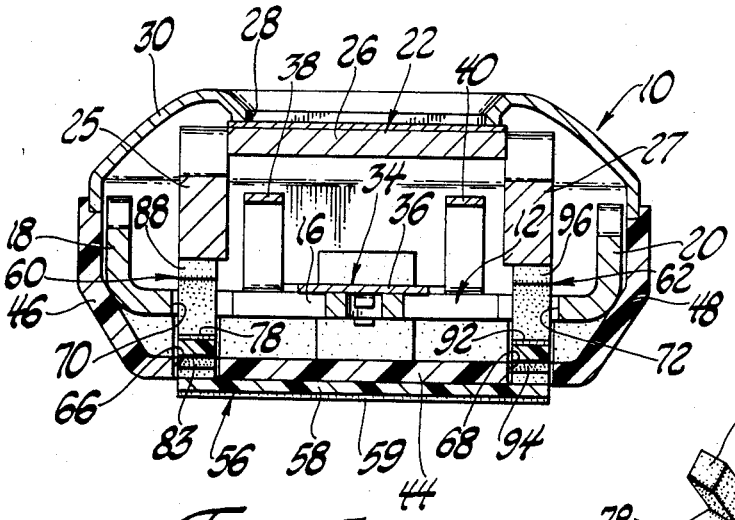
FIG. 3 is a sectional view taken in the direction of arrows 3—3 of FIG. 1.

According to FIG. 1, the conventional seat belt buckle of U.S. Pat. No. 4,064,603 by Louis N. Romanzi, Jr. issued Dec. 27, 1977 is indicated generally at 10 and includes a stamped steel body 12 which is connected to a belt 14. As best seen in FIGS. 1 and 3, the body 12 includes a base wall 16 and spaced apart upstanding side walls 18 and 20. A latch lever 22 is pivotally mounted on the body 12 and includes a tang 24 struck upwardly therefrom and a pair of laterally spaced arms 25 and 27 which support a pushbutton 26 which registers with a pushbutton opening 28 in a cover 30 which is suitably attached to the body 12. A spring, generally indicated at 34, includes a base portion 36 suitably mounted on the body 12 and a pair of spring leaves 38 and 40 which bear on the underside of the pushbutton 26 to hold the pushbutton 26 in its raised position of FIG. 1. The pushbutton 26 may be depressed to the phantom line indicated position of FIG. 1 as permitted by resilient yielding movement of the spring leaves 38 and 40. The resultant pivotal movement of the latch lever 22 lowers the tang 24 to the phantom line indicated position of FIG. 1. The buckle body 12 also includes a plastic bottom cover 44 which snaps onto the underside of the body base wall 16 and has side wall portions 46 and 48.

A latch plate 50 of stamped steel is suitably attached to the other portion of the seat belt and is inserted into the buckle 10 so that the entering latch plate cams the latch lever 22 downwardly and then the spring 24 returns the latch lever upwardly so that an aperture 52 of the latch plate 50 receives the tang 24 of the latch lever 22 to fasten the latch plate 50 within the buckle 10. Depressing the pushbutton 26 to the FIG. 1 phantom line indicated position lowers the tang 24 out of engagement with the aperture 52 of the latch plate 50 so that the latch plate 50 may be removed from the buckle 10, thus separating the seat belt buckle to permit occupant ingress and egress.

Figure 4:
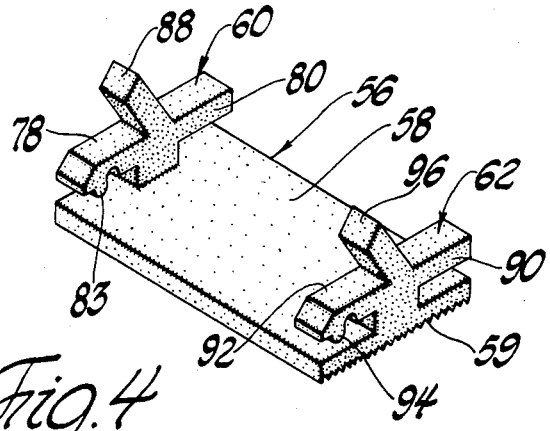
FIG. 4 is a perspective view of the molded plastic locking member.

The present invention provides a lock member, generally indicated at 56, which is adapted to lock the buckle against release by depression of the pushbutton 26. As best seen in FIG. 4, the lock member 56 is a molded plastic part including a body portion 58 having a knurled slide button 59 on its underface. The locking member has laterally spaced apart locking structures 60 and 62 adjacent its lateral edges for slidably mounting the locking member on the underside of the buckle.

Figure 2:
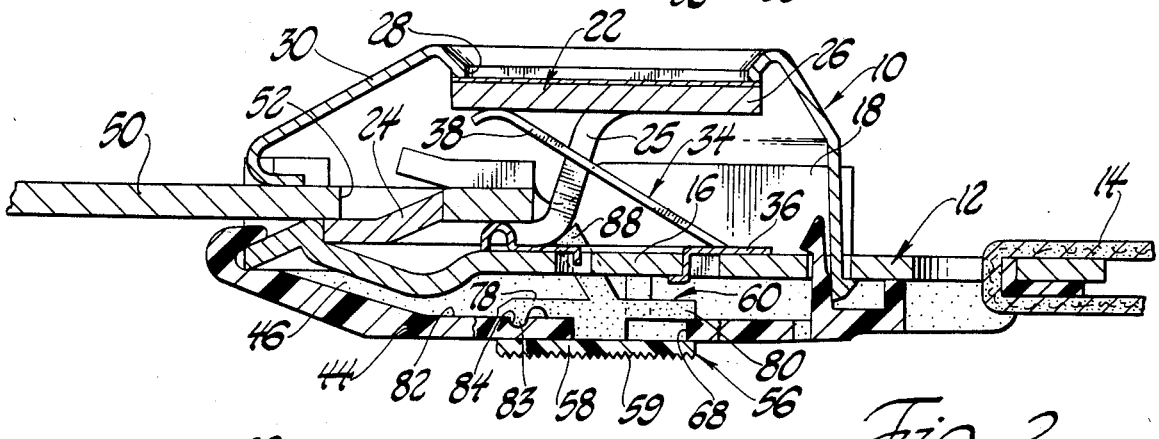
FIG. 2 is a view similar to FIG. 1 but showing the locking member of this invention in its locking condition.

As best seen in FIG. 3, the buckle bottom cover 44 has spaced apart slots 66 and 68 which register with slots 70 and 72 of the base wall 16 of the buckle body 12 to permit the locking member 56 to be installed onto the underside of the buckle with the body portion 58 thereof abutting against the underside of the bottom cover 44. As best seen in FIGS. 2 and 4, the locking structure 60 of the locking member 56 includes a pair of fingers 78 and 80 which slidably bear upon the top surface 82 of the bottom cover 44 to effectively capture the locking member 56 in its slidably mounted position on the bottom cover 44. Furthermore, the distal end of the finger 78 has a downwardly projecting detent tab 83 which is engageable with the edge wall of the slot 68 as shown in FIG. 1 to detent the locking member 56 at its rightward position of FIG. 1 and is also alternately engageable in a depression 84 in the top surface 82 of the buckle bottom cover 44 to detent the locking member 56 at its leftward position of FIG. 2.

The locking structure 60 of the locking member 56 also includes an upwardly projecting locking abutment 88 which, as seen in FIG. 1, is normally spaced away from the latch lever 22 to enable its movement between the solid line indicated position and its phantom line indicated position of FIG. 1. However, as seen in FIG. 2, sliding movement of the locking member 56 leftwardly carries the locking abutment 88 into locking position with respect to the arm 25 of latch lever 22.

As best seen in FIG. 4, the locking structure 62 of lock member 56 is constructed the same as the locking structure 60 and includes a pair of leaves 90 and 92, a detent tab 94, and a locking abutment 96 which assumes a position blocking the arm 27 of the latch lever 22.

Referring to FIG. 1, it is seen that the locking member 56 is normally held at its unlocking condition by the engagement of the detent tab 83 with the wall of the bottom cover slot 68 so that the locking abutments 88 and 96 are withdrawn away from the latch lever 22 to enable the occupant to depress the pushbutton 26 and thereby release the buckle.

In order to lock the buckle against its release by depressing the pushbutton 26, the occupant presses his thumb or finger against the knurled slide button 59 of the locking member 56 and slides the locking member 56 leftwardly to its position of FIG. 2 where the detent tabs 83 and 94 snap into the depressions in the top surface 82 of the buckle bottom cover 44. This leftward movement of the locking member 56 carries the locking abutments 88 and 96 into blocking engagement or proximity with the latch lever 22 to thereby prevent the pushbutton 26 from being depressed so that the tang 24 of the latch lever remains in its locking position with respect to the aperture 52 of the latch plate 50.

Thus, it is seen that the invention provides an improved seat belt buckle in which a locking member is slidable on the underside of the buckle to selectively block the pushbutton against movement to release the latch plate.

The embodiments of the invention in which an exclusive property or privilege is claimed are defined as follows:

1. A seat belt buckle comprising:

a body;

a latch lever movably mounted on the body and having a locking tang and a pushbutton;

spring means acting between the body and the latch lever to normally establish the latch lever at a position establishing the locking tang in locking engagement with the latch plate, said spring being yieldable to permit the occupant to move the latch lever to an unlatching position by depressing the pushbutton; and a locking member movably mounted on the body for occupant movement between locking and unlocking positions, said locking member having a locking abutment carried thereby adapted to block the latch lever against movement to the latch plate releasing position when the locking member is moved to its locking position and said locking member being withdrawn away from blocking the latch lever to permit normal unlatching by depression of the pushbutton whenever the locking member is moved to its unlocking position.

2. A seat belt buckle comprising:

a body having a topside and an underside;

a latch lever pivotally mounted on the topside of the body and having a locking tang and a pushbutton;

spring means acting between the body and the latch lever to normally establish the latch lever at a position establishing the locking tang in locking engagement with the latch plate, said spring being yieldable to permit the occupant to pivot the latch lever to an unlatching position by depressing the pushbutton towards the body; and a locking member slidably mounted on the underside of the body for occupant movement between locking and unlocking positions, said locking member having a locking abutment carried thereby adapted to block the latch lever against pivotal movement to the latch plate releasing position when the locking member is slid to its locking position and said locking abutment being withdrawn away from blocking the latch lever to permit normal unlatching by depression of the pushbutton whenever the locking member is slid to its unlocking position, and said locking member having associated detent means adapted to retain the locking member at the selected position thereof.

3. A seat belt buckle comprising:

a body having a topside and an underside;

a latch lever pivotally mounted on the topside of the body and having a locking tang and a pushbutton;

spring means acting between the body and the latch lever to normally establish the latch lever at a position establishing the locking tang in locking engagement with the latch plate, said spring being yieldable to permit the occupant to pivot the latch lever toward the body to an unlatching position by depressing the pushbutton toward the body; and a locking member slidably mounted on the underside of the body and having integrally molded locking structure having a locking abutment and a detent leave carrying a tab, said locking abutment being adapted to block the latch lever against pivotal movement to the latch plate releasing position when the locking member is slid to a locking position and said locking abutment being withdrawn away from blocking the latch lever to permit normal unlatching by depression of the pushbutton whenever the locking member is slid to a locking position, and said detent leave being adapted to operate the tab to coact with the body to retain the locking member at the locking or unlocking position thereof.

* * * * *